US007162968B2

(12) United States Patent
Thompson

(10) Patent No.: US 7,162,968 B2
(45) Date of Patent: Jan. 16, 2007

(54) BIMINI TOP HOOK

(76) Inventor: David M. Thompson, 802 Mantoloking Rd., Bricktown, NJ (US) 08723

( * ) Notice: Subject to any disclaimer, the term of this patent is extended or adjusted under 35 U.S.C. 154(b) by 18 days.

(21) Appl. No.: 11/203,720

(22) Filed: Aug. 15, 2005

(65) Prior Publication Data

US 2006/0090686 A1 May 4, 2006

Related U.S. Application Data

(63) Continuation-in-part of application No. 10/978,494, filed on Nov. 1, 2004, now abandoned.

(51) Int. Cl.
*B63B 17/00* (2006.01)

(52) U.S. Cl. ..... 114/361; 403/79

(58) Field of Classification Search ..... 114/361; 403/79, 66, 68, 119
See application file for complete search history.

(56) References Cited

U.S. PATENT DOCUMENTS 2,184,319 A * 12/1939 Schoeninger ..... 24/316
6,672,241 B1 1/2004 Warfel et al.
6,820,569 B1 * 11/2004 Warfel et al. ..... 114/361

* cited by examiner

*Primary Examiner*—Sherman Basinger
(74) *Attorney, Agent, or Firm*—Andrew W. Ludy

(57) ABSTRACT

A bimini top hook is used in connection with a boat and a bimini frame. The bimini top hook comprises an anchor having hook with a column extending upward from a base. The hook has an arch with a throat facing downward. A clevis is provided, and has a pin extending between two furcations. The pin pivotally engages the arch throat. A latch is provided, having a resilient lever arm extending from a body portion. The lever arm has a locking tab extending downward. The latch slidingly engages a column slot. The latch is selectively movable from a first position wherein the clevis pin is able to freely engage and disengage the top hook, to a second position wherein the locking tab is locked into engagement with the base and the clevis pin is locked into engagement with the throat.

20 Claims, 11 Drawing Sheets

BIMINI TOP HOOK

CROSS-REFERENCE TO RELATED APPLICATIONS

This application is a continuation-in-part of prior application Ser. No. 10/978,494, filed in the United States on Nov. 1, 2004, now abandoned. The prior application is expressly incorporated herein by reference.

BACKGROUND OF THE INVENTION

This invention relates to the field of latches, and more particularly to a hook and latch for securing a clevis and pin, especially for mounting a marine bimini top on a pontoon boat.

Bimini tops for boats are well known in the art. Typically, they are made of canvas or synthetic material, and supported by aluminum or stainless steel tube frames. The frames are pivotally and removably attached to the boat gunwale or railing by screws or pin-type fasteners. These fasteners must be removed in order to change the bimini top from a storage position to a deployed position. This operation usually requires tools, such as a screwdriver. The fasteners can easily be lost. The parts must be realigned to install the fasteners.

One solution to these problems is seen in the U.S. Pat. No. 6,672,241, granted to Warfel et al., which discloses brackets attached to the boat gunwale or hand railing. Warfel is shown in FIGS. 1 and 2. Latching members are mounted on the ends of the frames. The latching members envelop smooth pins on the brackets. A raised lip on a lever arm holds the latching member in engagement with the pin. A light force on the lever arm moves the raised lip away from the pin, causing the latch to disengage. The problem with Warfel is that a sideways force on the latch could cause the pin to lift the raised lip, resulting in a disengagement of the latching member from the bracket, and subsequent collapse of the bimini top. This could follow from a passenger kicking or leaning on the frame, grasping the frame for support, or striking the frame with an object such as a paddle or a ski. Such inadvertent disengagement constitutes a potential safety hazard on a pitching, rolling boat.

Accordingly, there is a need to provide a bimini top hook that can be quickly, easily, and selectively engaged and disengaged with a mating bracket.

There is a further need to provide a bimini top hook of the type described and that can be utilized without fasteners or tools.

There is a yet further need to provide a bimini top hook of the type described and wherein a sideways force on the latch will not disengage the latch from the bracket, thereby ensuring safety at sea.

There is a still further need to provide a bimini top hook of the type described and that is robust in construction, for reliability and long service life.

There is another need to provide a bimini top hook of the type described and that can be manufactured cost-effectively in large quantities of high quality.

BRIEF SUMMARY OF THE INVENTION

In accordance with the present invention, a bimini top hook is used in connection with a boat and a bimini frame. The bimini top hook comprises an anchor having a base extending longitudinally between opposite first and second ends. The base extends transversely between opposite inner and outer edges. The base has a bottom surface for mounting on the boat, and an opposite top surface. The anchor has a hook with a column extending upward from a proximal end integral with the base top surface to a distal end. The column has a slot extending longitudinally through it. The hook has an arch with a first end integral with the column distal end and a second end terminating facing downward. The arch has a throat facing downward. The anchor has a space between the arch second end and the base top surface. The base has at least one mounting hole extending from the top surface through to the bottom surface.

The bimini top hook also comprises a clevis having a central portion. The clevis has two furcations spaced apart and extending from proximal ends at the central portion to distal ends. The furcations have collinear holes extending through each furcation at the distal ends. The clevis has a pilot attached to the central portion opposite the furcations, for mounting the clevis to the bimini frame.

A pin is inserted into the clevis holes and extends between the furcations. The pin is adapted to pivotally engage the arch throat.

A latch is provided, having a body portion extending longitudinally between opposite first and second ends. The latch has a lever arm extending from a proximal end at the body portion to a distal end. The lever arm has a locking tab adjacent the distal end and extending downward. The latch is adapted to slidingly engage the column slot. The latch is selectively movable. In a first position, the locking tab resiliently rests upon the base top surface. In this position, the latch first end is clear of the throat, and the clevis pin is able to freely engage and disengage the bimini top hook. In a transitory position, the lever arm distal end is raised manually against bias. In a second position, the locking tab resiliently engages the base second end. In this position, the latch first end is blocking the throat, and the clevis pin is thereby locked into engagement with the throat.

BRIEF DESCRIPTION OF THE SEVERAL VIEWS OF THE DRAWING

A more complete understanding of the present invention may be obtained from consideration of the following description in conjunction with the drawing, in which.

DETAILED DESCRIPTION OF THE INVENTION

Figure 1:
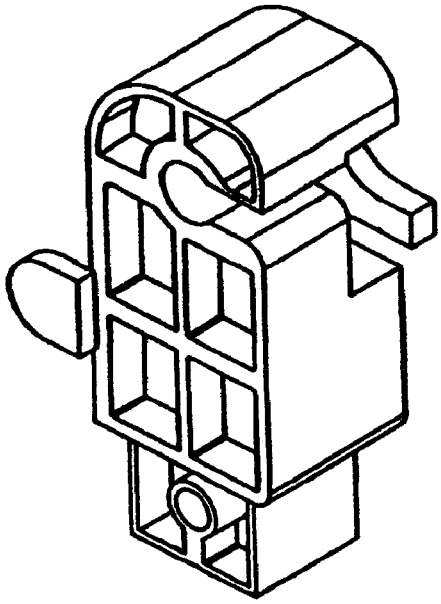
FIG. 1 PRIOR ART
FIG. 1 is a prior art U.S. Pat. No. 6,672,241, granted to Warfel et al.
Figure 2:
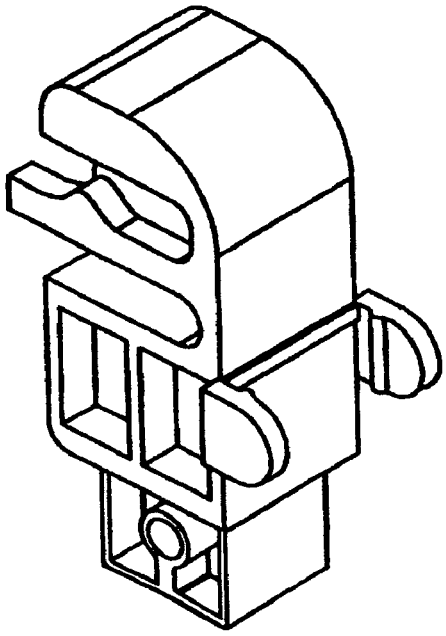
FIG. 2 PRIOR ART
FIG. 2 is another view of Warfel et al.
Figure 3:
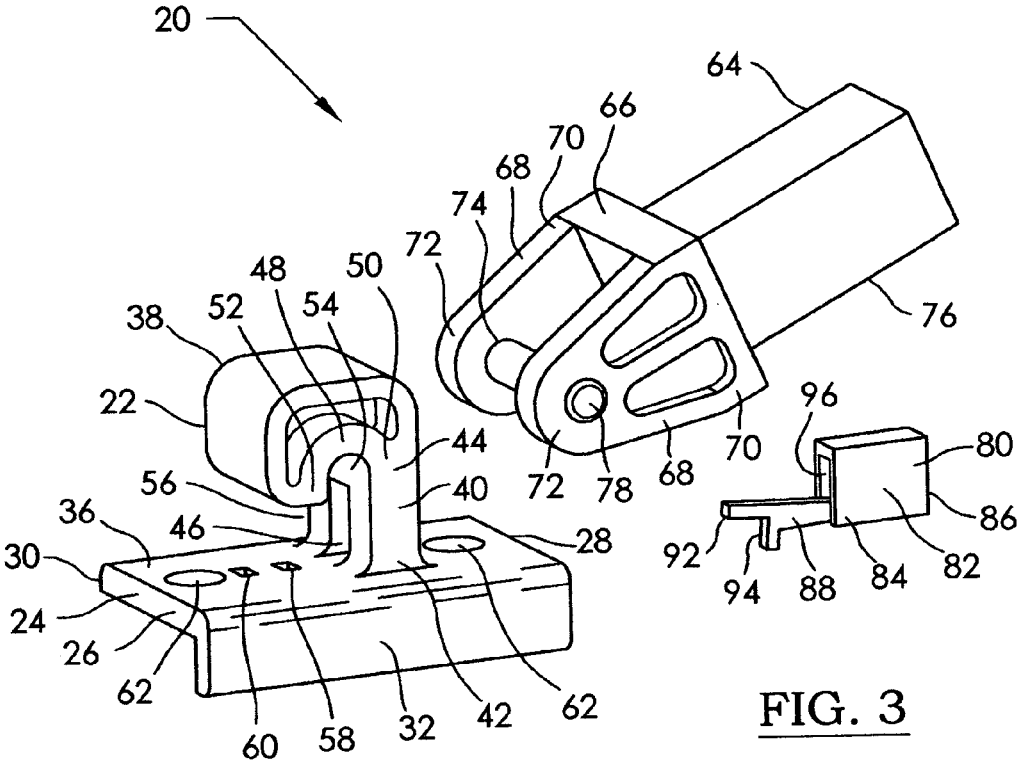
FIG. 3 is an exploded assembly perspective view of a bimini top hook constructed in accordance with the invention.
Figure 4:
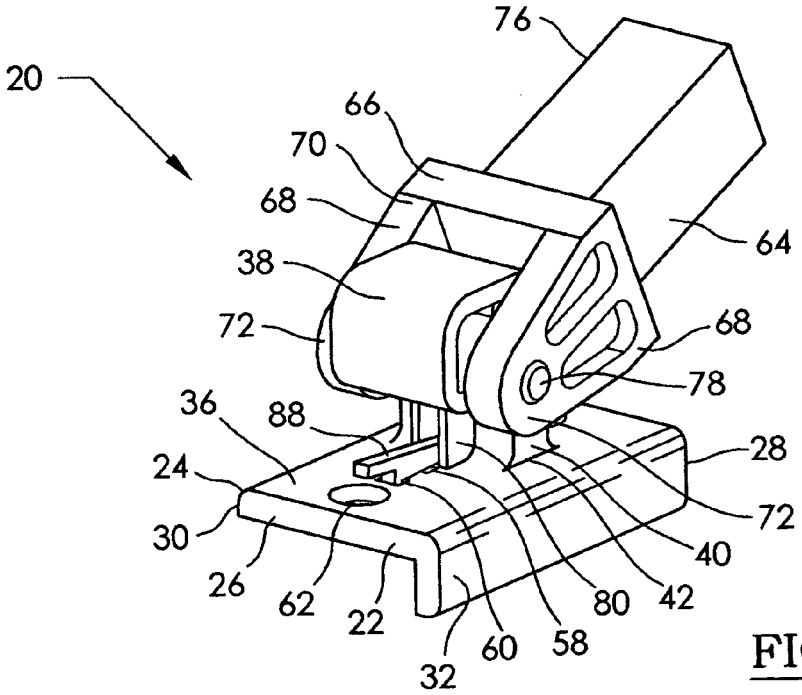
FIG. 4 is a contracted assembly perspective view of the bimini top hook of FIG. 3.
Figure 5:
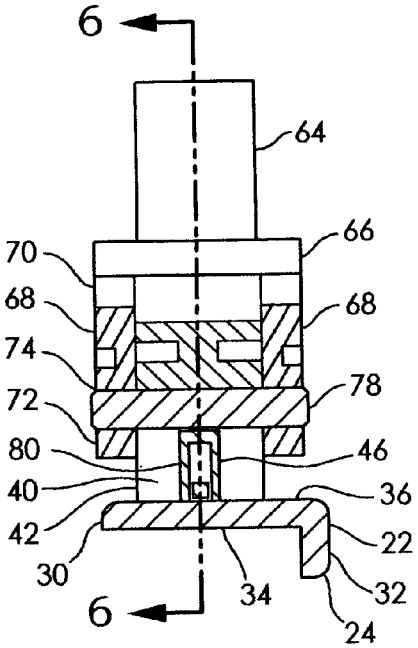
FIG. 5 is a front sectional elevational view of the bimini top hook of FIG. 3, taken along lines 5—5 of FIG. 6A.

Referring now to the drawing, and especially to FIGS. 3, 4, 5, 6A, 6B and 6C thereof, a bimini top hook constructed in accordance with the invention is shown at 20, and is for use in connection with a boat and a bimini frame (not shown). The bimini top hook comprises an anchor 22 having a base 24 extending longitudinally between opposite first 26 and second 28 ends. The base 24 extends transversely between opposite inner 30 and outer 32 edges. The base 24 has a bottom surface 34 for mounting on the boat, and an opposite top surface 36. The anchor 22 has a hook 38 with a column 40 extending upward from a proximal end 42 integral with the base top surface to a distal end 44. The column 40 has a slot 46 extending longitudinally through it. The hook 38 has an arch 48 with a first end 50 integral with the column distal end 44 and a second end 52 terminating facing downward. The arch has a throat 54 facing downward. The anchor 22 has a space 56 between the arch second end 52 and the base top surface 36. The base 24 has first 58 and second 60 locking holes extending downward from the base top surface 36. The base 24 has at least one mounting hole 62, and preferably two mounting holes 62, extending from the top surface 36 through to the bottom surface 34.

The bimini top hook 20 also comprises a clevis 64 having a central portion 66. The clevis 64 has two furcations 68 spaced apart and extending from proximal ends 70 at the central portion to distal ends 72. The furcations 68 have collinear holes 74 extending through each furcation 68 at the distal ends 72. The clevis 64 has a pilot 76 attached to the central portion 66 opposite the furcations 68, for mounting the clevis 64 to the bimini frame. The pilot 76 is inserted into the bimini frame and fastened with rivets or screws.

A pin 78 is inserted into the collinear holes 74 and extends between the furcations 68. The pin 78 is adapted to pivotally engage the arch throat 54. The pin is preferably made from a metal such as stainless steel.

Figure 6A:
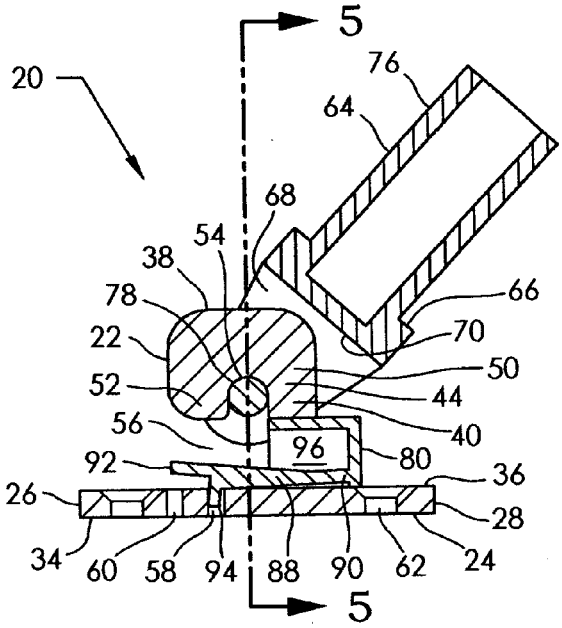
FIG. 6A is a right side sectional elevational view of the bimini top hook of FIG. 3, taken along lines 6—6 of FIG. 5, and showing the latch in the open position.
Figure 6B:
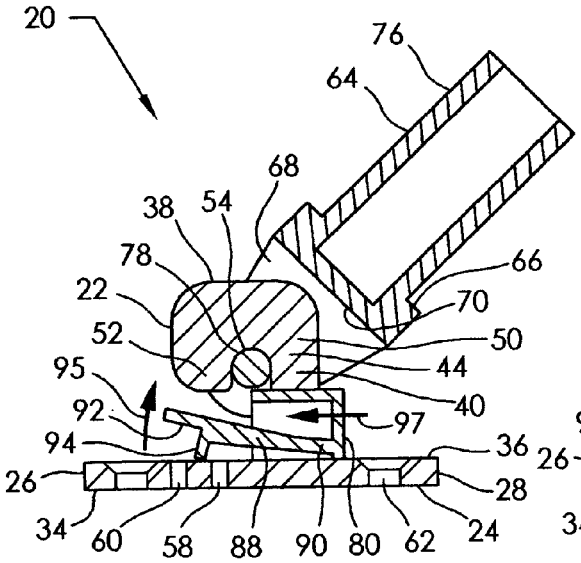
FIG. 6B is a right side sectional elevational view of the bimini top hook of FIG. 3, taken along lines 6—6 of FIG. 5, and showing the latch in the transitory position.
Figure 6C:
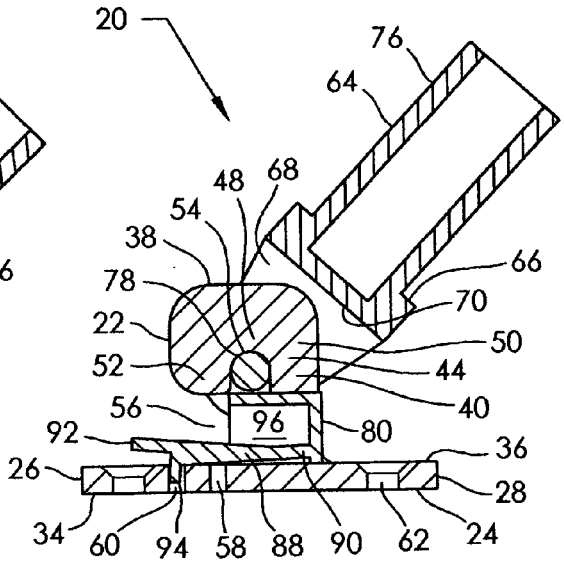
FIG. 6C is a right side sectional elevational view of the bimini top hook of FIG. 3, taken along lines 6—6 of FIG. 5, and showing the latch in the closed position.
Figure 7:
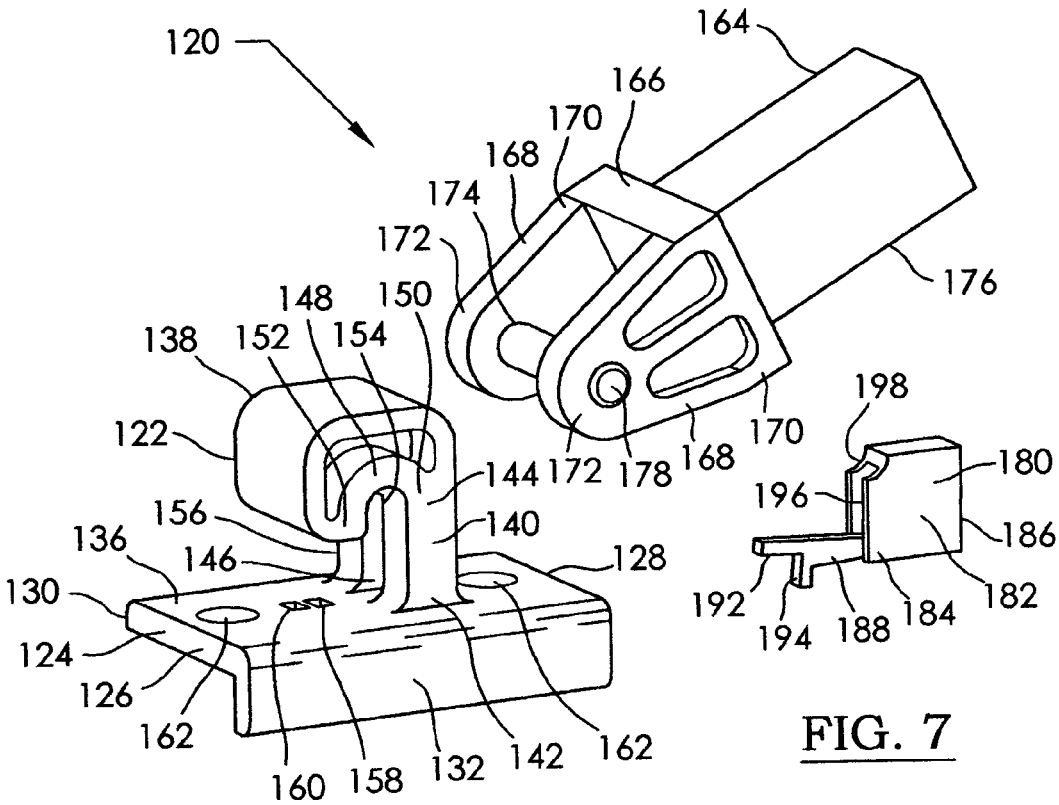
FIG. 7 is an exploded assembly perspective view of another bimini top hook constructed in accordance with the invention.
Figure 8:
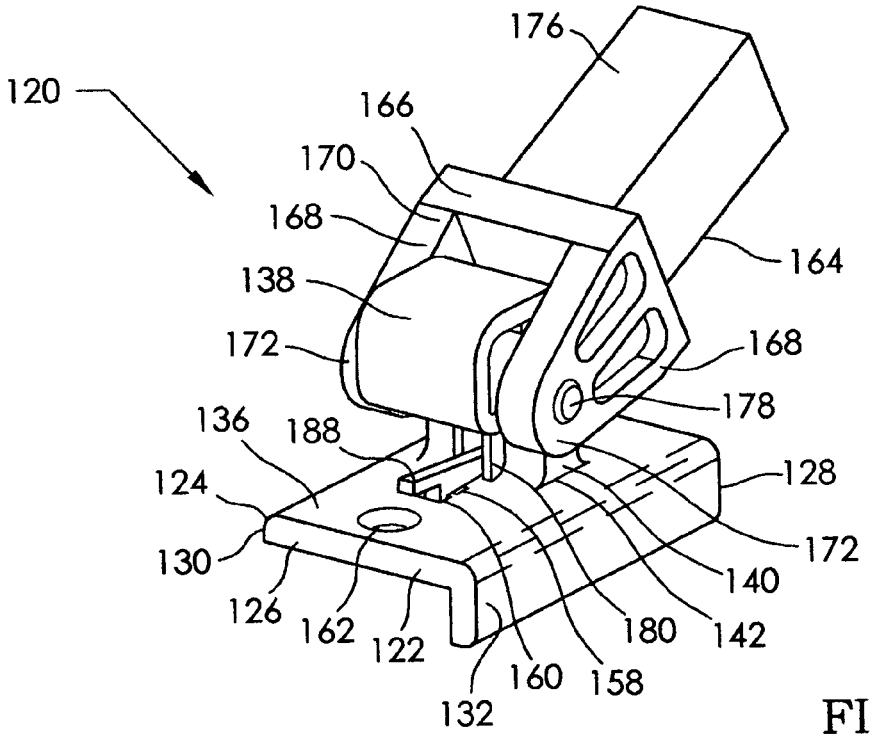
FIG. 8 is a contracted assembly perspective view of the bimini top hook of FIG. 7.
Figure 9:
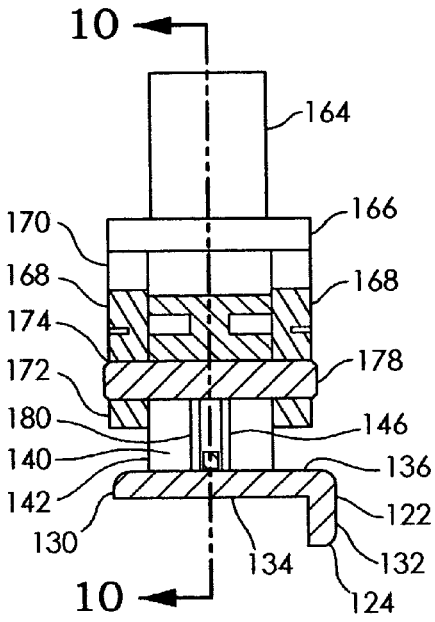
FIG. 9 is a front sectional elevational view of the bimini top hook of FIG. 7, taken along lines 9—9 of FIG. 10A.

A latch 80 is provided, having a body portion 82 extending longitudinally between opposite first 84 and second 86 ends. The latch 80 includes a cavity 96 open at the first end 84. Locking means is provided for selectively locking the latch in the first and second positions. Specifically, the locking means includes a latch lever arm 88 extending from a proximal end 90 at the body portion to a distal end 92. The lever arm proximal end 90 is attached to the body portion second end 86 inside the cavity 96. The lever arm 88 extends freely through the cavity 96, and out the open first end 84. The lever arm 88 has a locking tab 94 adjacent the distal end 92 and extending downward. The latch 80 is adapted to slidingly engage the column slot 46. The latch 80 is selectively movable. In a first position, the locking tab 94 resiliently engages the first locking hole 58. In this position, the latch first end 84 is clear of the throat 54 as shown in FIG. 6A, and the clevis pin 78 is able to freely engage and disengage the throat 54. In a transitory position, the lever arm distal end 92 is raised manually against bias, as shown by arrow 95 in FIG. 6B, to disengage the locking tab 94 from the locking hole 58. The latch 80 is then able to slide, shown by arrow 97, to a second position. In the second position, the locking tab 94 resiliently engages the second locking hole 60. In this position, the latch first end 84 is blocking the throat as shown in FIG. 6C, and the clevis pin 78 is thereby locked into engagement with the throat 54. The lever arm 88 tapers from a predetermined thickness adjacent the locking tab 94, to less than the predetermined thickness adjacent the proximal end 90, so that the lever arm 88 will flex adjacent the proximal end 90.

The latch body portion 82, lever arm 88, and locking tab 94, are molded in one piece from a plastic resin. The anchor 22 is also molded in one piece from a plastic resin. The clevis 64, likewise, is molded in one piece from a plastic resin. The plastic resin has sufficient resilience to bias the locking tab 94 downward, while having sufficient flexibility to allow the lever arm 88 to move upward to disengage the locking tab 94. The plastic resin selected by one skilled in the art also shall have sufficient strength and stiffness to support the pin 78 against loads imposed upon it by the bimini.

Turning now to FIGS. 7, 8, 9, 10A, 10B, and 10C, another bimini top hook constructed in accordance with the invention is shown at 120, and is similar to bimini top hook 20 described above, in that the bimini top hook 120 comprises an anchor 122 having a base 124 extending longitudinally between opposite first 126 and second 128 ends. The base 124 extends transversely between opposite inner 130 and outer 132 edges. The base 124 has a bottom surface 134 for mounting on the boat, and an opposite top surface 136. The anchor 122 has a hook 138 with a column 140 extending upward from a proximal end 142 integral with the base top surface to a distal end 144. The column 140 has a slot 146 extending longitudinally through it. The hook 138 has an arch 148 with a first end 150 integral with the column distal end 144 and a second end 152 terminating facing downward. The arch has a throat 154 facing downward. The anchor 122 has a space 156 between the arch second end 152 and the base top surface 136. The base 124 has first 158 and second 160 locking holes extending downward from the base top surface 136. The base 124 has at least one, and preferably two, mounting holes 162 extending from the top surface 136 through to the bottom surface 134.

The bimini top hook 120 also comprises a clevis 164 having a central portion 166. The clevis 164 has two furcations 168 spaced apart and extending from proximal ends 170 at the central portion to distal ends 172. The furcations 168 have collinear holes 174 extending through each furcation 168 at the distal ends 172. The clevis 164 has a pilot 176 attached to the central portion 166 opposite the furcations 168, for mounting the clevis 164 to the bimini frame.

A pin 178 is inserted into the collinear holes 174 and extends between the furcations 168. The pin 178 is adapted to pivotally engage the arch throat 154. The pin is preferably made from a metal such as stainless steel.

Figure 10A:
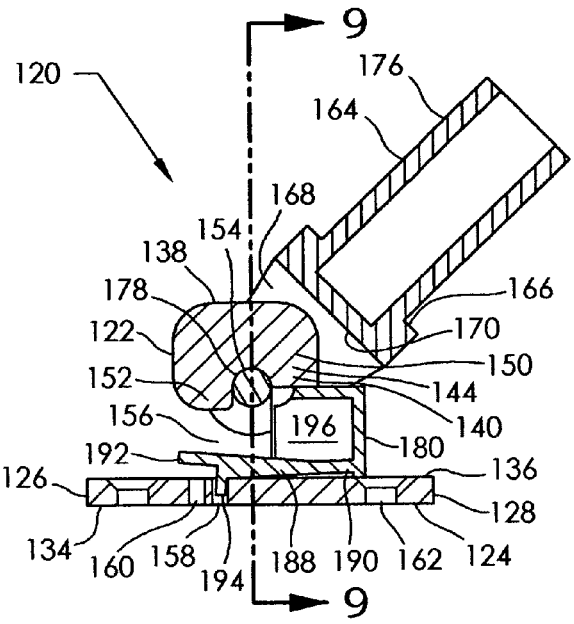
FIG. 10A is a right side sectional elevational view of the bimini top hook of FIG. 7, taken along lines 10—10 of FIG. 9, and showing the latch in the open position.
Figure 10B:
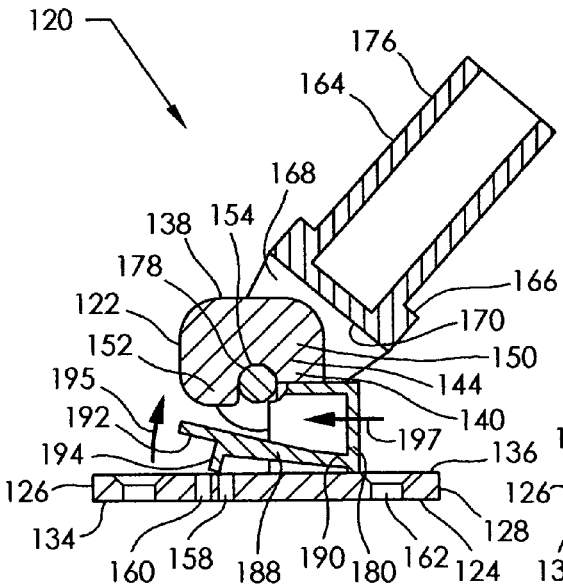
FIG. 10B is a right side sectional elevational view of the bimini top hook of FIG. 7, taken along lines 10—10 of FIG. 9, and showing the latch in the transitory position.
Figure 10C:
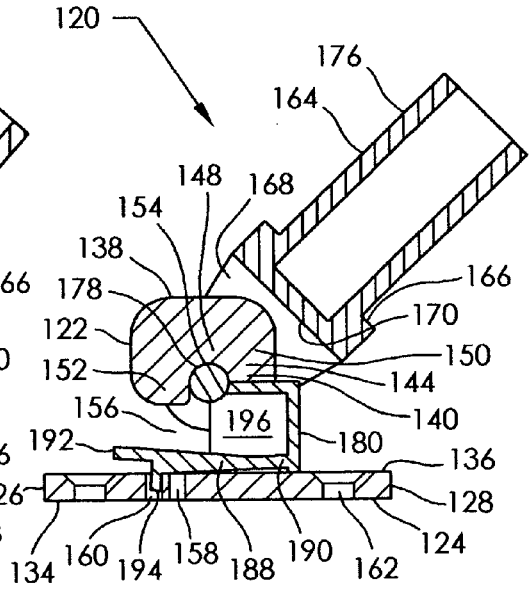
FIG. 10C is a right side sectional elevational view of the bimini top hook of FIG. 7, taken along lines 10—10 of FIG. 9, and showing the latch in the closed position.
Figure 12:
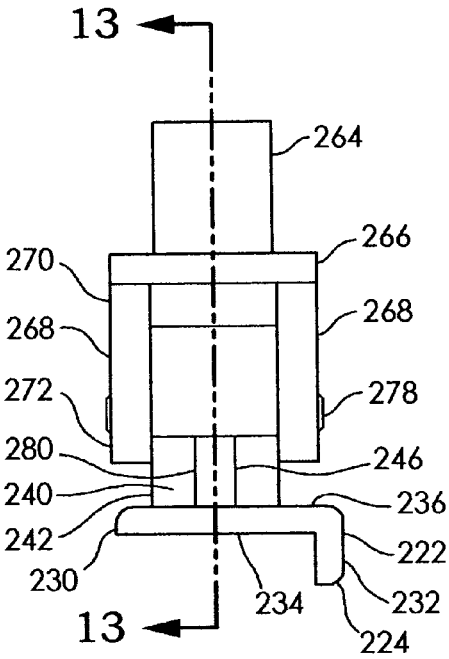
FIG. 12 is a front elevational view of the bimini top hook of FIG. 11.

A latch 180 is provided, having a body portion 182 extending longitudinally between opposite first 184 and second 186 ends. The latch 180 includes a cavity 196 open at the first end 184. The latch includes a lever arm 188 extending from a proximal end 190 at the body portion to a distal end 192. The lever arm proximal end 190 is attached to the body portion second end 186 inside the cavity 196. The lever arm 188 extends freely through the cavity 196, and out the open first end 184. The lever arm 188 has a locking tab 194 adjacent the distal end 192 and extending downward. The latch 180 is adapted to slidingly engage the column slot 146. The latch 180 is selectively movable. In a first position, the locking tab 194 resiliently engages the first locking hole 158. In this position, the latch first end 184 is clear of the throat 154 as shown in FIG. 10A, and the clevis pin 178 is able to freely engage and disengage the throat 154. In a transitory position, the lever arm distal end 192 is raised manually against bias, as shown by arrow 195 in FIG. 10B, to disengage the locking tab 194 from the locking hole 158. The latch 180 is then able to slide, shown by arrow 197, to a second position. In the second position, the locking tab 194 resiliently engages the second locking hole 160. In this position, the latch first end 184 is blocking the throat as shown in FIG. 10C, and the clevis pin 178 is thereby locked into engagement with the throat 154. The lever arm 188 tapers from a predetermined thickness adjacent the locking tab 194, to less than the predetermined thickness adjacent the proximal end 190, so that the lever arm 188 will flex adjacent the proximal end 190. The latch 180, anchor 122, and clevis 164, are molded in one piece from a plastic resin.

Bimini top hook 120 differs from bimini top hook 20 described above, in that the latch body portion 182 includes a concave notch 198 extending transversely across it. The notch 198 has a radius generally conforming to the radius of the pin 178. The increased surface area of the latch allows it to more closely support the pin.

Referring now to FIGS. 11, 12, 13A, and 13B, yet another bimini top hook constructed in accordance with the invention is shown at 220, and is similar to bimini top hook 20 described above, in that the bimini top hook 220 comprises an anchor 222 having a base 224 extending longitudinally between opposite first 226 and second 228 ends. The base 224 extends transversely between opposite inner 230 and outer 232 edges. The base 224 has a bottom surface 234 for mounting on the boat, and an opposite top surface 236. The anchor 222 has a hook 238 with a column 240 extending upward from a proximal end 242 integral with the base top surface to a distal end 244. The column 240 has a slot 246 extending longitudinally through it. The hook 238 has an arch 248 with a first end 250 integral with the column distal end 244 and a second end 252 terminating facing downward. The arch has a throat 254 facing downward. The anchor 222 has a space 256 between the arch second end 252 and the base top surface 236. The base 224 has first 258 and second 260 locking holes extending downward from the base top surface 236. The base 224 has at least one, and preferably two, mounting holes 262 extending from the top surface 236 through to the bottom surface 234.

The bimini top hook 220 also comprises a clevis 264 having a central portion 266. The clevis 264 has two furcations 268 spaced apart and extending from proximal ends 270 at the central portion to distal ends 272. The furcations 268 have collinear holes 274 extending through each furcation 268 at the distal ends 272. The clevis 264 has a pilot 276 attached to the central portion 266 opposite the furcations 268, for mounting the clevis 264 to the bimini frame.

A pin 278 is inserted into the collinear holes 274 and extends between the furcations 268. The pin 278 is adapted to pivotally engage the arch throat 254. The pin is preferably made from a metal such as stainless steel.

Figure 13A:
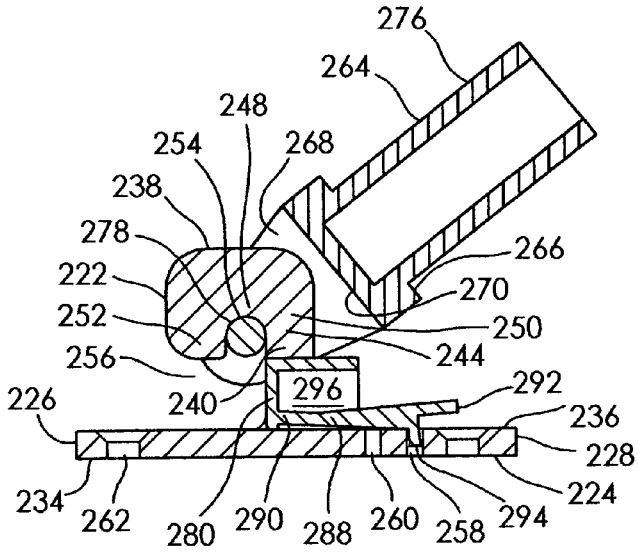
FIG. 13A is a right side sectional elevational view of the bimini top hook of FIG. 11, taken along lines 13—13 of FIG. 12, and showing the latch in the open position.
Figure 11:
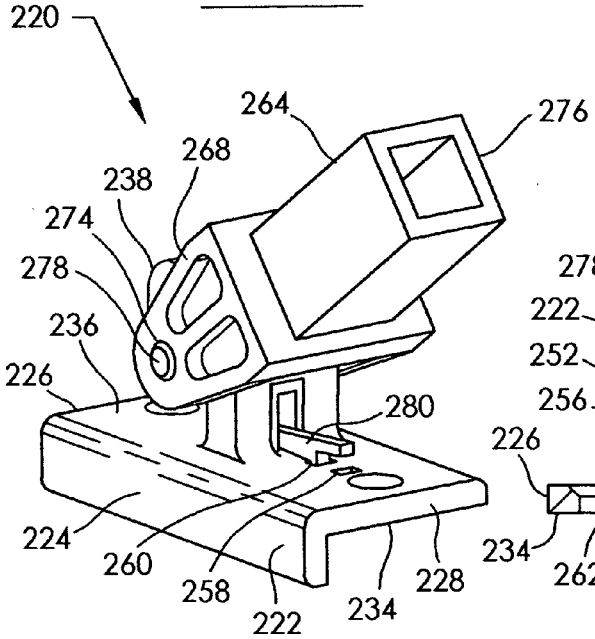
FIG. 11 is an exploded assembly perspective view of yet another bimini top hook constructed in accordance with the invention.
Figure 13B:
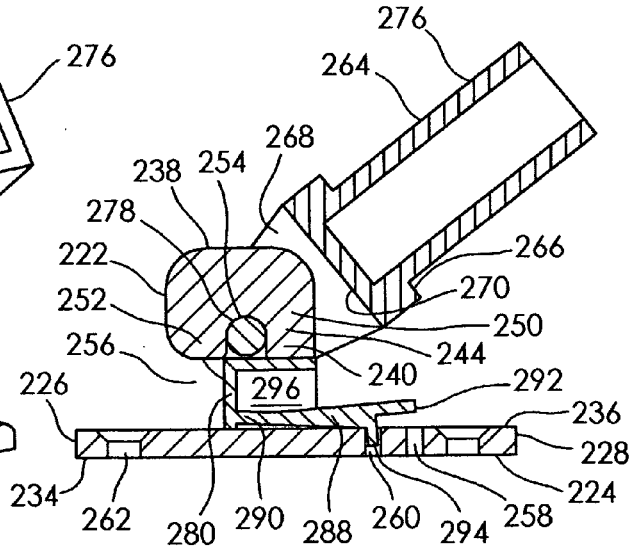
FIG. 13B is a right side sectional elevational view of the bimini top hook of FIG. 11, taken along lines 13—13 of FIG. 12, and showing the latch in the closed position.
Figure 14:
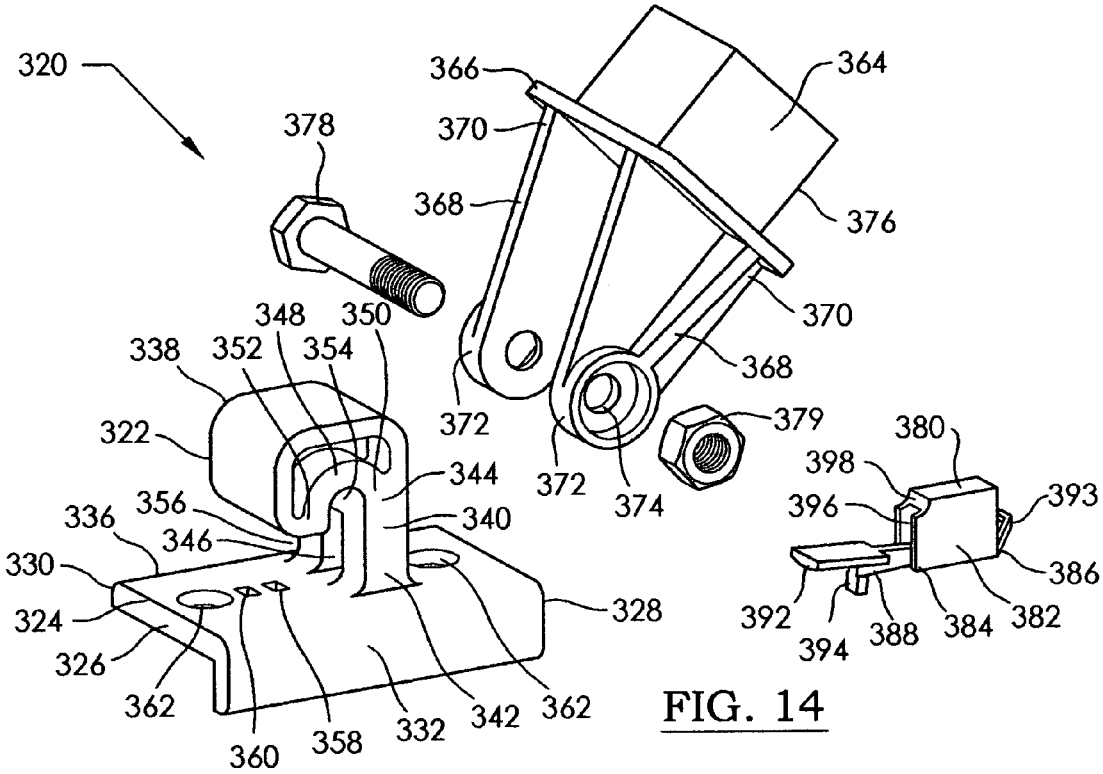
FIG. 14 is an exploded assembly perspective view of still another bimini top hook constructed in accordance with the invention.
Figure 15:
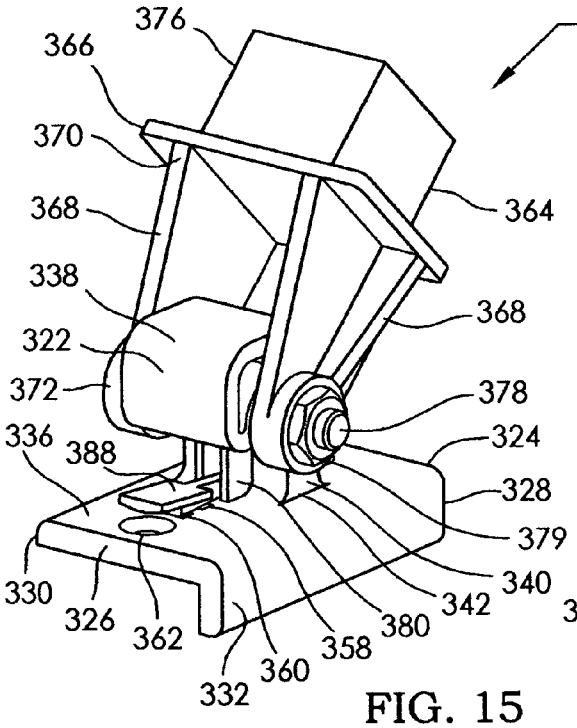
FIG. 15 is a contracted assembly perspective view of the bimini top hook of FIG. 14, showing the anchor first end.
Figure 16:
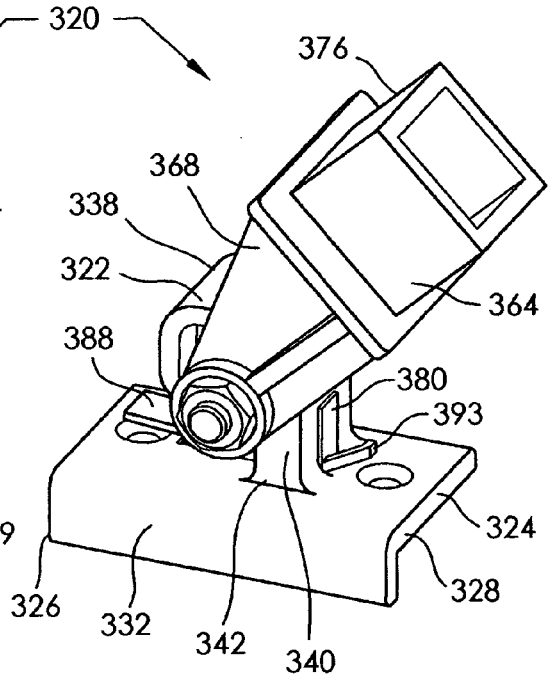
FIG. 16 is a contracted assembly perspective view of the bimini top hook of FIG. 14 showing the anchor second end.
Figure 18:
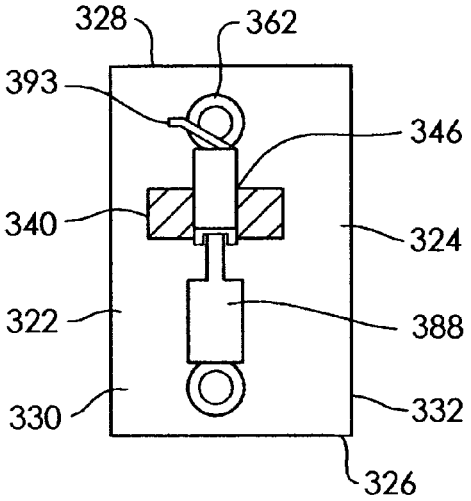
FIG. 18 is a top view of the bimini top hook of FIG. 14, taken along lines 18—18 of FIG. 17.

A latch 280 is provided, having a body portion 282 extending longitudinally between opposite first 284 and second 286 ends. The latch 280 includes a cavity 296 open at the first end 284. The latch includes a lever arm 288 extending from a proximal end 290 at the body portion to a distal end 292. The lever arm proximal end 290 is attached to the body portion second end 286 inside the cavity 296. The lever arm 288 extends freely through the cavity 296, and out the open first end 284. The lever arm 288 has a locking tab 294 adjacent the distal end 292 and extending downward. The latch 280 is adapted to slidingly engage the column slot 246. The latch 280 is selectively movable. In a first position, the locking tab 294 resiliently engages the first locking hole 258. In this position, the latch first end 284 is clear of the throat 254 as shown in FIG. 13A, and the clevis pin 278 is able to freely engage and disengage the throat 254. In a second position, the locking tab 294 resiliently engages the second locking hole 260. In this position, the latch first end 284 is blocking the throat as shown in FIG. 13B, and the clevis pin 278 is thereby locked into engagement with the throat 254. The lever arm 288 tapers from a predetermined thickness adjacent the locking tab 294, to less than the predetermined thickness adjacent the proximal end 290, so that the lever arm 288 will flex adjacent the proximal end 290. The latch 280, anchor 222, and clevis 264, are molded in one piece from a plastic resin.

Bimini top hook 220 differs from bimini top hook 20 described above, in that the latch 280 is reversed in relation to the base 224.

Turning now to FIGS. 14, 15, 16, 17, 18, 19A and 19B, still another embodiment of the bimini top hook constructed in accordance with the invention is shown at 320, and is similar to bimini top hook 20 described above, in that the bimini top hook 320 comprises an anchor 322 having a base 324 extending longitudinally between opposite first 326 and second 328 ends. The base 324 extends transversely between opposite inner 330 and outer 332 edges. The base 324 has a bottom surface 334 for mounting on the boat, and an opposite top surface 336. The anchor 322 has a hook 338 with a column 340 extending upward from a proximal end 342 integral with the base top surface to a distal end 344. The column 340 has a slot 346 extending longitudinally through it. The hook 338 has an arch 348 with a first end 350 integral with the column distal end 344 and a second end 352 terminating facing downward. The arch has a throat 354 facing downward. The anchor 322 has a space 356 between the arch second end 352 and the base top surface 336. The base 324 has first 358 and second 360 locking holes extending downward from the base top surface 336. The base 324 has at least one, and preferably two, mounting holes 362 extending from the top surface 336 through to the bottom surface 334.

The bimini top hook 320 also comprises a clevis 364 having a central portion 366. The clevis 364 has two furcations 368 spaced apart and extending from proximal ends 370 at the central portion to distal ends 372. The furcations 368 have collinear holes 374 extending through each furcation 368 at the distal ends 372. The clevis 364 has a pilot 376 attached to the central portion 366 opposite the furcations 368, for mounting the clevis 364 to the bimini frame.

A pin 378 is inserted into the collinear holes 374 and extends between the furcations 368. Typically, the pin 378 comprises a bolt 378 and a nut 379. The pin 378 is adapted to pivotally engage the arch throat 354. The pin 378 is preferably made from a metal such as stainless steel.

Figure 19A:
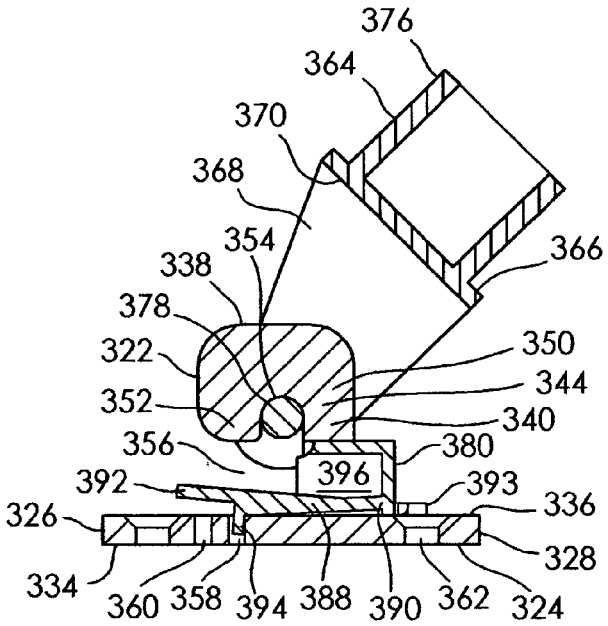
FIG. 19A is a right side sectional elevational view of the bimini top hook of FIG. 14, taken along lines 19—19 of FIG. 17, and showing the latch in the open position.
Figure 17:
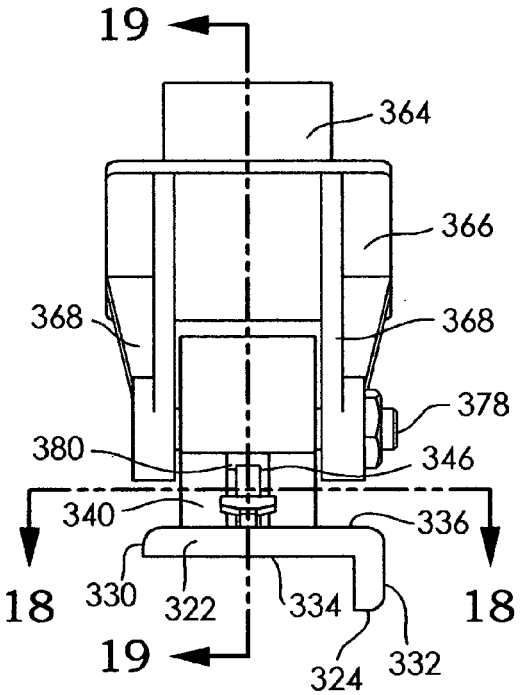
FIG. 17 is a front sectional elevational view of the bimini top hook of FIG. 14.
Figure 19B:
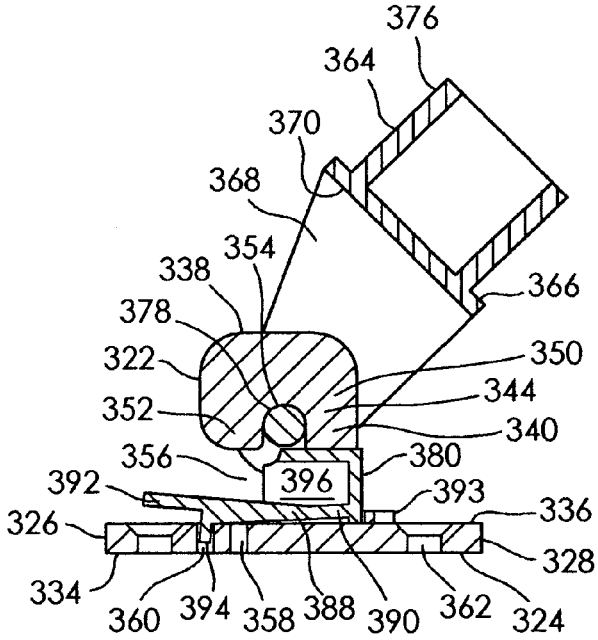
FIG. 19B is a right side sectional elevational view of the bimini top hook of FIG. 14, taken along lines 19—19 of FIG. 17, and showing the latch in the closed position.
Figure 20:
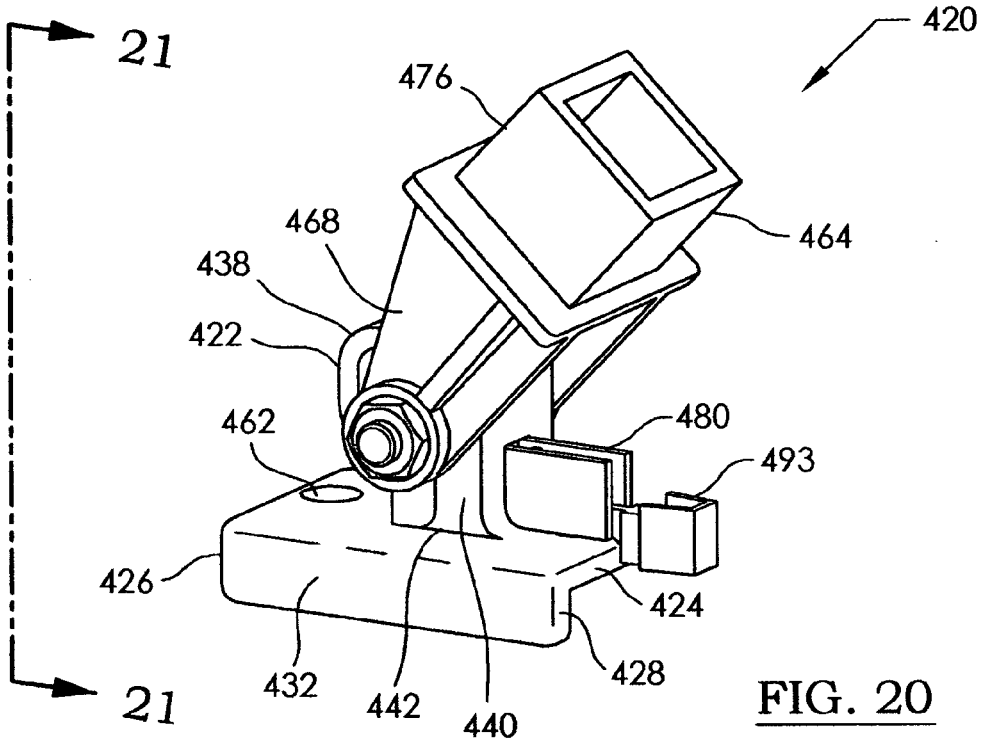
FIG. 20 is an assembly perspective view of a further bimini top hook constructed in accordance with the invention.
Figure 21:
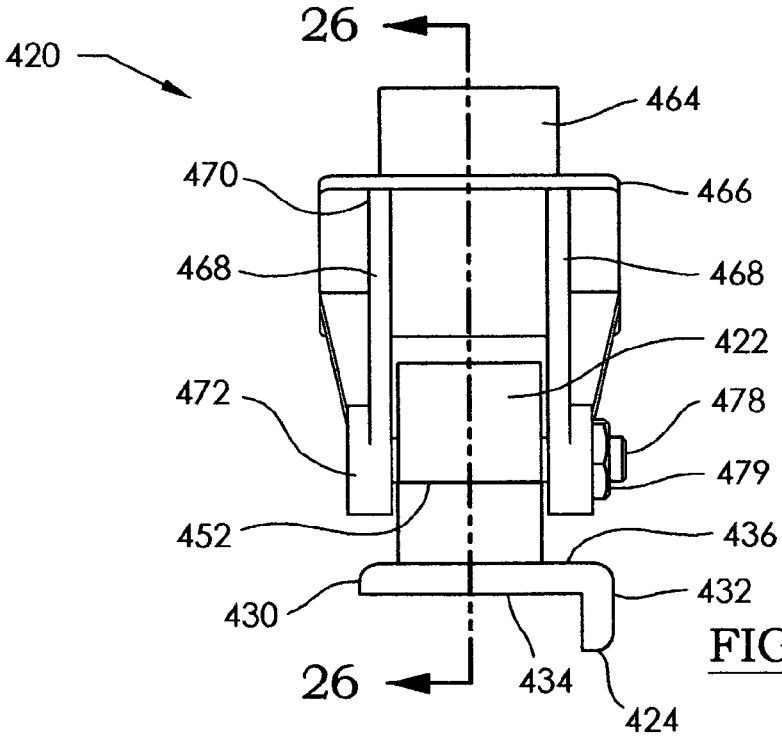
FIG. 21 is a front elevational view of the bimini top hook of FIG. 20, taken along lines 21—21 of FIG. 20.
Figure 22:
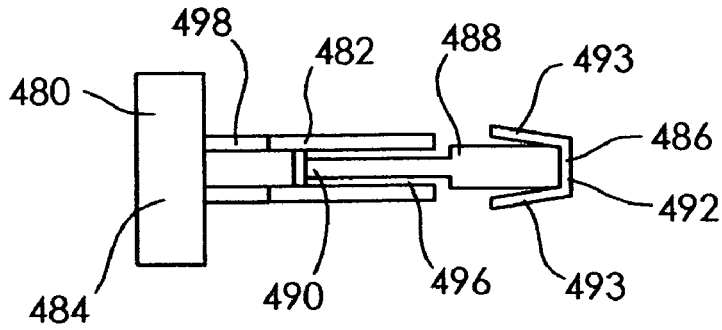
FIG. 22 is a top view of the latch of the bimini top hook of FIG. 20.
Figure 23:
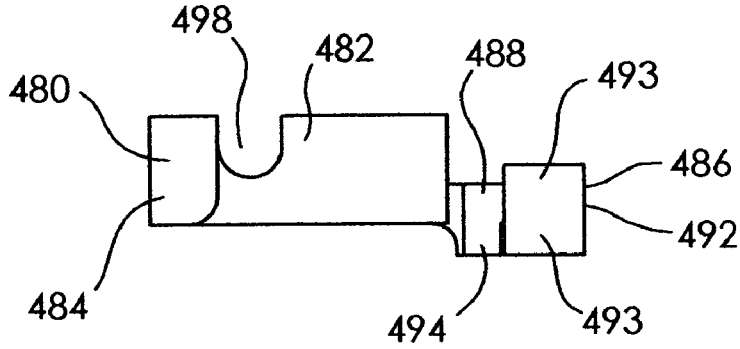
FIG. 23 is a side elevational view of the latch of the bimini top hook of FIG. 20.
Figure 24:
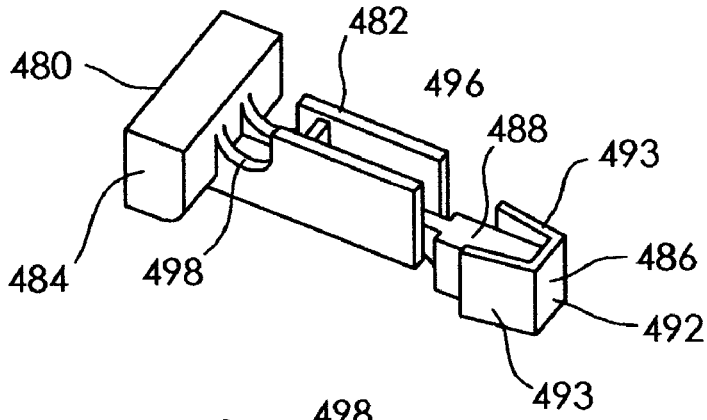
FIG. 24 is a perspective view of the latch of the bimini top hook of FIG. 20, showing the side and top aspects.
Figure 25:
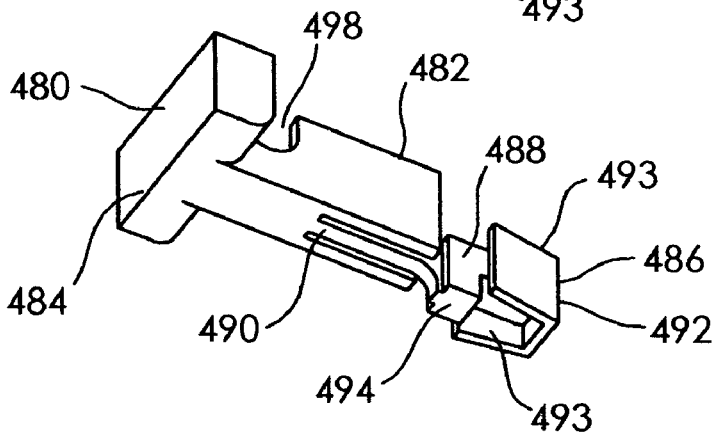
FIG. 25 is a perspective view of the latch of the bimini top hook of FIG. 20, showing the side and bottom aspects.

A latch 380 is provided, having a body portion 382 extending longitudinally between opposite first 384 and second 386 ends. The latch 380 includes a cavity 396 open at the first end 384. The latch includes a lever arm 388 extending from a proximal end 390 at the body portion to a distal end 392. The lever arm proximal end 390 is attached to the body portion second end 386 inside the cavity 396. The lever arm 388 extends freely through the cavity 396, and out the open first end 384. The lever arm 388 has a locking tab 394 adjacent the distal end 392 and extending downward. The latch 380 is adapted to slidingly engage the column slot 346. The latch 380 is selectively movable. In a first position, the locking tab 394 resiliently engages the first locking hole 358. In this position, the latch first end 384 is clear of the throat 354 as shown in FIG. 19A, and the clevis pin 378 is able to freely engage and disengage the throat 354. In a second position, the locking tab 394 resiliently engages the second locking hole 360. In this position, the latch first end 384 is blocking the throat as shown in FIG. 19B, and the clevis pin 378 is thereby locked into engagement with the throat 354. The lever arm 388 tapers from a predetermined thickness adjacent the locking tab 394, to less than the predetermined thickness adjacent the proximal end 390, so that the lever arm 388 will flex adjacent the proximal end 390. The latch 380, anchor 322, and clevis 364, are molded in one piece from a plastic resin.

Bimini top hook 320 differs from bimini top hook 20 described above, in that the latch body portion 382 includes a notch 398 extending transversely across it. The notch 398 allows the clevis pin 378 to clear the latch first end 384. Latch 380 further comprises a stop finger 393 extending transversely from the latch second end 386, so as to prevent the latch second end 386 from passing through the slot 346. The latch 380 is assembled into the column slot 346 by bending the stop finger 393 sufficiently to pass through the slot 346. A handle 396 is attached to the lever arm distal end 392. This facilitates manual grasping of the lever arm distal end 392. The handle 396 is wider than the slot 346, so as to prevent the latch first end 384 from passing through the slot 346. The stop finger 393 and the handle 396 help to prevent accidental loss of the latch 380.

Turning now to FIGS. 20, 21, 22, 23, 24, 25, 26A, 26B, 26C, and 26D, a further embodiment of the bimini top hook constructed in accordance with the invention is shown at 420, and is similar to bimini top hook 20 described above, in that the bimini top hook 420 comprises an anchor 422 having a base 424 extending longitudinally between opposite first 426 and second 428 ends. The base 424 extends transversely between opposite inner 430 and outer 432 edges. The base 424 has a bottom surface 434 for mounting on the boat, and an opposite top surface 436. The anchor 422 has a hook 438 with a column 440 extending upward from a proximal end 442 integral with the base top surface to a distal end 444. The column 440 has a slot 446 extending longitudinally through it. The hook 438 has an arch 448 with a first end 450 integral with the column distal end 444 and a second end 452 terminating facing downward. The arch has a throat 454 facing downward. The anchor 422 has a space 456 between the arch second end 452 and the base top surface 436. The base 424 has at least one, and preferably two, mounting holes 462 extending from the top surface 436 through to the bottom surface 434.

The bimini top hook 420 also comprises a clevis 464 having a central portion 466. The clevis 464 has two furcations 468 spaced apart and extending from proximal ends 470 at the central portion to distal ends 472. The furcations 468 have collinear holes 474 extending through each furcation 468 at the distal ends 472. The clevis 464 has a pilot 476 attached to the central portion 466 opposite the furcations 468, for mounting the clevis 464 to the bimini frame.

A pin 478 is inserted into the collinear holes 474 and extends between the furcations 468. Typically, the pin 478 comprises a bolt 478 and a nut 479. The pin 478 is adapted to pivotally engage the arch throat 454. The pin 478 is preferably made from a metal such as stainless steel.

Figure 26A:
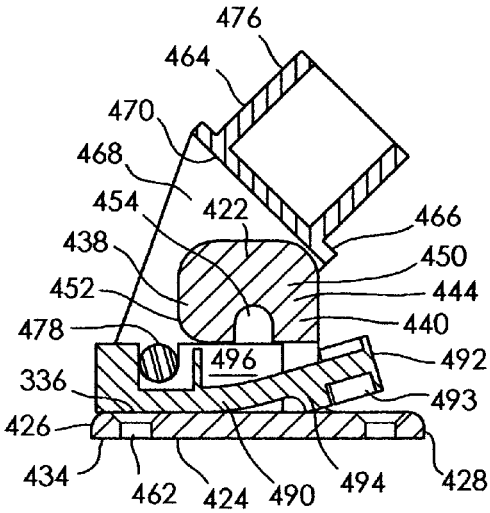
FIG. 26A is a right side sectional elevational view of the bimini top hook of FIG. 20, taken along lines 26—26 of FIG. 21, and showing the latch in the open position.
Figure 26B:
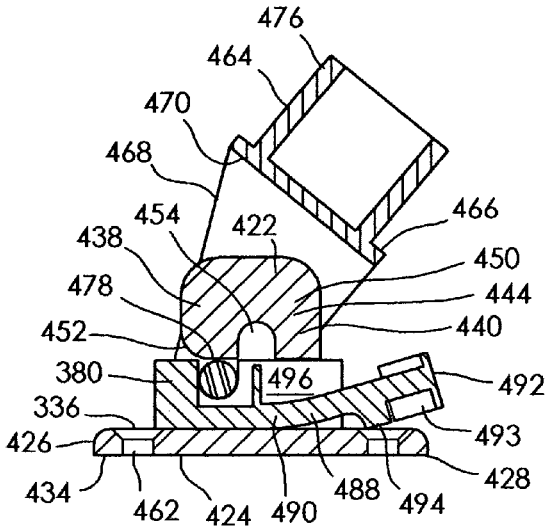
FIG. 26B is a right side sectional elevational view of the bimini top hook of FIG. 20, taken along lines 26—26 of FIG. 21, and showing the latch in a transitory position.
Figure 26C:
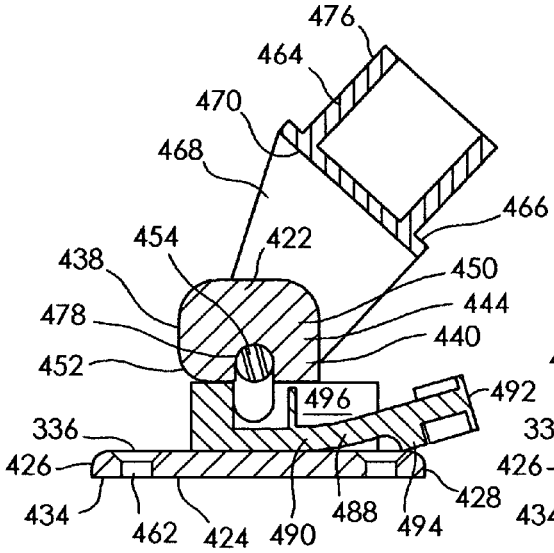
FIG. 26C is a right side sectional elevational view of the bimini top hook of FIG. 20, taken along lines 26—26 of FIG. 21, and showing the latch in another transitory position.
Figure 26D:
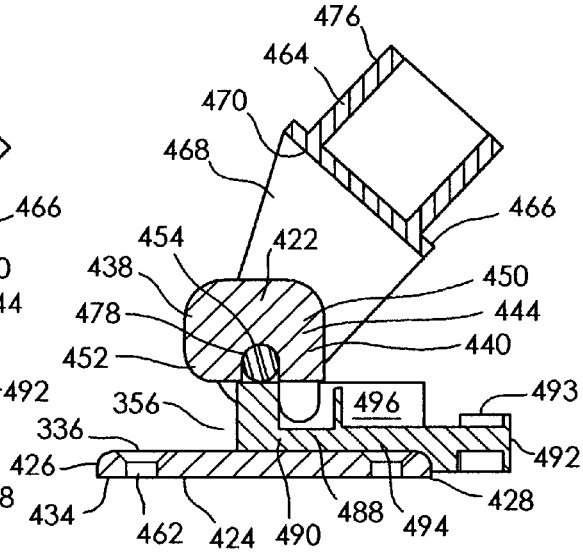
FIG. 26D is a right side sectional elevational view of the bimini top hook of FIG. 20, taken along lines 26—26 of FIG. 21, and showing the latch in the closed position.

A latch 480 is provided, having a body portion 482 extending longitudinally between opposite first 484 and second 486 ends. The latch 480 includes a cavity 496 open at the first end 484. The latch includes a lever arm 488 extending from a proximal end 490 at the body portion to a distal end 492. The lever arm proximal end 490 is attached to the body portion inside the cavity 496. The lever arm 488 extends freely through the cavity 496, and out the open second end 486. The lever arm 488 has a locking tab 494 adjacent the distal end 492 and extending downward. The latch 480 is adapted to slidingly engage the column slot 446. The latch 480 is selectively movable. In a first position, the locking tab 494 resiliently rests upon the base top surface 436. In this position, the latch first end 484 is clear of the throat 454 as shown in FIG. 26A, and the clevis pin 478 is able to freely engage and disengage the notch 498. In a transitory position, the notch 498 is underneath the arch second end 452, as shown in FIG. 26B. In another transitory position, the latch first end 484 is underneath the arch second end 452, and the notch 498 is underneath the throat 454, as shown in FIG. 26C. This allows the pin 478 to move upward into the throat 454. In a second position, the locking tab 494 resiliently engages the base second end, as shown in FIG. 26D, and is thereby locked in place. In this position, the latch first end 484 is blocking the throat, and the clevis pin 478 is thereby locked into engagement with the throat 454. The latch 480, anchor 422, and clevis 464, are molded in one piece from a plastic resin.

Bimini top hook 420 differs from bimini top hook 20 described above, in that the latch body portion 482 includes a notch 498 extending transversely across it. The notch 498 allows the clevis pin 478 to clear the latch first end 484. Latch 480 further comprises at least one, and preferably a pair of resilient, opposed stop fingers 493 extending outward transversely from either side of the latch second end 486, and extending from the latch second end 486 part way toward the latch first end 484, so as to allow the latch second end 486 to pass through the slot 446 in one direction, and prevent the latch second end 486 from passing through the slot 446 in an opposite direction. The latch 480 is assembled into the column slot 446 by inserting the latch second end 486 into the slot 446. The stop fingers 493 will flex sufficiently to pass through the slot 446. The stop fingers 493 help to prevent accidental loss of the latch 480. Another difference is that the locking tab 494 resiliently engages the base second end 428, instead of locking holes.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

PARTS LIST

BIMINI TOP HOOK

Part

No. Description

20 bimini top hook
22 anchor
24 base
26 first end
28 second end
30 inner edge
32 outer edge
34 base bottom surface
36 base top surface
38 hook
40 column
42 proximal end
44 distal end
46 slot
48 arch
50 arch first end
52 arch second end
54 arch throat
56 space
58 first locking hole
60 second locking hole
62 mounting hole
64 clevis
66 clevis central portion
68 clevis furcations
70 furcations proximal ends
72 furcations distal ends
74 collinear holes
76 pilot
78 pin
80 latch
82 latch body portion
84 latch first end
86 latch second end
88 latch lever arm
90 lever arm proximal end
92 lever arm distal end
94 latch locking tab
95 arrow
96 latch cavity
97 arrow
120 bimini top hook
122 anchor
124 base
126 first end
128 second end
130 inner edge
132 outer edge
134 base bottom surface
136 base top surface
138 hook
140 column
142 proximal end
144 distal end
146 slot
148 arch
150 arch first end
152 arch second end
154 arch throat
156 space
158 first locking hole
160 second locking hole
162 mounting hole
164 clevis
166 clevis central portion
168 clevis furcations
170 furcations proximal ends
172 furcations distal ends
174 collinear holes
176 pilot
178 pin
180 latch
182 latch body portion
184 latch first end
186 latch second end
188 latch lever arm
190 lever arm proximal end

192 lever arm distal end
194 latch locking tab
195 arrow
196 latch cavity
197 arrow
198 latch concave notch
220 bimini top hook
222 anchor
224 base
226 first end
228 second end
230 inner edge
232 outer edge
234 base bottom surface
236 base top surface
238 hook
240 column
242 proximal end
244 distal end
246 slot
248 arch
250 arch first end
252 arch second end
254 arch throat
256 space
258 first locking hole
260 second locking hole
262 mounting hole
264 clevis
266 clevis central portion
268 clevis furcations
270 furcations proximal ends
272 furcations distal ends
274 collinear holes
276 pilot
278 pin
280 latch
282 latch body portion
284 latch first end
286 latch second end
288 latch lever arm
290 lever arm proximal end
292 lever arm distal end
294 latch locking tab
296 latch cavity
320 bimini top hook
322 anchor
324 base
326 first end
328 second end
330 inner edge
332 outer edge
334 base bottom surface
336 base top surface
338 hook
340 column
342 proximal end
344 distal end
346 slot
348 arch
350 arch first end
352 arch second end
354 arch throat
356 space
358 first locking hole
360 second locking hole
362 mounting hole
364 clevis
366 clevis central portion
368 clevis furcations
370 furcations proximal ends
372 furcations distal ends
374 collinear holes
376 pilot
378 pin or bolt
379 nut
380 latch
382 latch body portion
384 latch first end
386 latch second end
388 latch lever arm
390 lever arm proximal end
392 lever arm distal end
393 latch stop finger
394 latch locking tab
395 latch handle
396 latch cavity
398 latch concave notch
420 bimini top hook
422 anchor
424 base
426 first end
428 second end
430 inner edge
432 outer edge
434 base bottom surface
436 base top surface
438 hook
440 column
442 proximal end
444 distal end
446 slot
448 arch
450 arch first end
452 arch second end
454 arch throat
456 space
462 mounting hole
464 clevis
466 clevis central portion
468 clevis furcations
470 furcations proximal ends
472 furcations distal ends
474 collinear holes
476 pilot
478 pin or bolt
479 pin
480 latch
482 latch body portion
484 latch first end
486 latch second end
488 latch lever arm
490 lever arm proximal end
492 lever arm distal end
493 latch stop finger
494 latch locking tab
496 latch cavity
498 latch concave notch The embodiments of the invention in which an exclusive property or privilege is claimed are defined as follows:

1. A bimini top hook, for use in connection with a boat and a bimini frame, the bimini top hook comprising:

an anchor, the anchor having a base extending longitudinally between opposite first and second ends, and extending transversely between opposite inner and outer edges, the base having a bottom surface for mounting on the boat, and an opposite top surface, the anchor having a hook, the hook having a column extending upward from a proximal end integral with the base top surface to a distal end, the column having a slot extending longitudinally through the column, the hook having an arch with a first end integral with the column distal end and a second end terminating facing downward, the arch having a throat facing downward, the anchor having a space between the arch second end and the base top surface, the base having at least one mounting hole extending from the top surface through to the bottom surface;

a clevis, the clevis having a central portion, the clevis having two furcations spaced apart and extending from proximal ends at the central portion to distal ends, the furcations having collinear holes extending through each furcation at the distal ends, the clevis having a pilot attached to the central portion opposite the furcations, for mounting the clevis to the bimini frame;

a pin inserted into the collinear holes and extending between the furcations, the pin being adapted to pivotally engage the arch throat;

a latch, the latch having a body portion extending longitudinally between opposite first and second ends, the latch being adapted to slidingly engage the column slot, the latch being selectively movable from a first position wherein the latch first end is clear of the throat, and the clevis pin is able to freely engage and disengage the bimini top hook, to a second position wherein the latch first end is blocking the throat, and the clevis pin is thereby locked into engagement with the throat; and locking means for selectively locking the latch in the second position, and unlocking the latch so as to move the latch into the first position.

2. The bimini top hook of claim 1, wherein the pin further comprises a bolt and a nut.

3. The bimini top hook of claim 1, wherein the locking means further comprises:

the base having first and second locking holes extending downward from the base top surface;

the latch having a lever arm extending from a proximal end at the body portion to a distal end, the lever arm having a locking tab adjacent the distal end and extending downward;

wherein the locking tab resiliently engages the first locking hole in the first position;

wherein the locking tab resiliently engages the second locking hole in the second position; and wherein the lever arm distal end is adapted to be raised manually against bias to disengage the locking tab from the locking hole in a transitory position.

4. The bimini top hook of claim 3, wherein:

the body portion, lever arm, and locking tab are molded in one piece from a plastic resin, the plastic resin having sufficient resilience to bias the locking tab downward, the plastic resin having sufficient flexibility to allow the lever arm to move upward to disengage the locking tab, the plastic resin having sufficient strength and stiffness to support the pin against loads imposed upon it by the bimini.

5. The bimini top hook of claim 3, wherein:

the latch includes a cavity open at one of the first and second ends;

the lever arm extends freely through the cavity; and the lever arm proximal end is attached to the body portion inside the cavity.

6. The bimini top hook of claim 3, wherein the latch further comprises a handle attached to the lever arm distal end, so as to facilitate manual grasping of the lever arm distal end, the handle being wider than the slot, so as to prevent the latch first end from passing through the slot.

7. The bimini top hook of claim 1, wherein the locking means further comprises:

the latch having a lever arm extending from a proximal end at the body portion to a distal end, the lever arm having a locking tab adjacent the distal end and extending downward;

wherein the locking tab resiliently rests upon the base top surface in the first position;

wherein the locking tab resiliently engages the base second end in the second position; and wherein the lever arm distal end is adapted to be raised manually against bias to disengage the locking tab from the base second end in a transitory position.

8. The bimini top hook of claim 7, wherein:

the body portion, lever arm, and locking tab are molded in one piece from a plastic resin, the plastic resin having sufficient resilience to bias the locking tab downward, the plastic resin having sufficient flexibility to allow the lever arm to move upward to disengage the locking tab, the plastic resin having sufficient strength and stiffness to support the pin against loads imposed upon it by the bimini.

9. The bimini top hook of claim 7, wherein:

the latch includes a cavity open at one of the first and second ends;

the lever arm extends freely through the cavity; and the lever arm proximal end is attached to the body portion inside the cavity.

10. The bimini top hook of claim 7, wherein the latch body portion includes a concave notch extending transversely, the notch having a radius generally conforming to the pin, to more closely support the pin.

11. The bimini top hook of claim 7, wherein the latch further comprises at least one stop finger extending transversely from the latch second end, so as to prevent the latch second end from passing through the slot.

12. A bimini top hook, for use in connection with a boat and a bimini frame, the bimini top hook comprising:

an anchor, the anchor having a base extending longitudinally between opposite first and second ends, and extending transversely between opposite inner and outer edges, the base having a bottom surface for mounting on the boat, and an opposite top surface, the anchor having a hook, the hook having a column extending upward from a proximal end integral with the base top surface to a distal end, the column having a slot extending longitudinally through the column, the hook having an arch with a first end integral with the column distal end and a second end terminating facing downward, the arch having a throat facing downward, the anchor having a space between the arch second end and the base top surface, the base having at least one mounting hole extending from the top surface through to the bottom surface;

a clevis, the clevis having a central portion, the clevis having two furcations spaced apart and extending from proximal ends at the central portion to distal ends, the furcations having collinear holes extending through each furcation at the distal ends, the clevis having a pilot attached to the central portion opposite the furcations, for mounting the clevis to the bimini frame;

a pin inserted into the collinear holes and extending between the furcations, the pin being adapted to pivotally engage the arch throat; and a latch, the latch having a body portion extending longitudinally between opposite first and second ends, the latch having a lever arm extending from a proximal end at the body portion to a distal end, the lever arm having a locking tab adjacent the distal end and extending downward, the latch being adapted to slidingly engage the column slot, the latch being selectively movable from a first position wherein the locking tab resiliently rests upon the base top surface, the latch first end is clear of the throat, and the clevis pin is able to freely engage and disengage the bimini top hook, to a transitory position wherein the lever arm distal end is raised manually against bias, to a second position wherein the locking tab resiliently engages the base second end, the latch first end is blocking the throat, and the clevis pin is thereby locked into engagement with the throat.

13. The bimini top hook of claim 12, wherein the pin further comprises a bolt and a nut.

14. The bimini top hook of claim 12, wherein the body portion, lever arm, and locking tab are molded in one piece from a plastic resin, the plastic resin having sufficient resilience to bias the locking tab downward, the plastic resin having sufficient flexibility to allow the lever arm to move upward to disengage the locking tab, the plastic resin having sufficient strength and stiffness to support the pin against loads imposed upon it by the bimini.

15. The bimini top hook of claim 12, wherein:

the latch includes a cavity open at one of the first and second ends;

the lever arm extends freely through the cavity; and the lever arm proximal end is attached to the body portion inside the cavity.

16. The bimini top hook of claim 12, wherein the latch body portion includes a concave notch extending transversely, the notch having a radius generally conforming to the pin, to more closely support the pin.

17. The bimini top hook of claim 12, wherein the latch further comprises at least one stop finger extending transversely from the latch second end, so as to prevent the latch second end from passing through the slot.

18. A bimini top hook, for use in connection with a boat and a bimini frame, the bimini top hook comprising:

an anchor molded in one piece from a plastic resin, the anchor having a base extending longitudinally between opposite first and second ends, and extending transversely between opposite inner and outer edges, the base having a bottom surface for mounting on the boat, and an opposite top surface, the anchor having a hook, the hook having a column extending upward from a proximal end integral with the base top surface to a distal end, the column having a slot extending longitudinally through the column, the hook having an arch with a first end integral with the column distal end and a second end terminating facing downward, the arch having a throat facing downward, the anchor having a space between the arch second end and the base top surface, the base having at least one mounting hole extending from the top surface through to the bottom surface;

a clevis molded in one piece from a plastic resin, the clevis having a central portion, the clevis having two furcations spaced apart and extending from proximal ends at the central portion to distal ends, the furcations having collinear holes extending through each furcation at the distal ends, the clevis having a pilot attached to the central portion opposite the furcations, for mounting the clevis to the bimini frame;

a pin inserted into the collinear holes and extending between the furcations, the pin being adapted to pivotally engage the arch throat;

a latch, the latch having a body portion extending longitudinally between opposite first and second ends, the latch body portion being adapted to slidingly engage the column slot, the latch body portion having a concave notch extending transversely adjacent the first end, the notch having a radius generally conforming to the pin, the body portion having a cavity open at the second end, the latch having a lever arm with a proximal end attached to the body portion inside the cavity, the lever arm extending freely through the cavity to a distal end, so that the lever arm will flex resiliently adjacent the proximal end, the lever arm having a locking tab adjacent the distal end and extending downward, the latch being selectively movable from a first position wherein the locking tab resiliently rests upon the base top surface, the latch first end is clear of the throat, and the clevis pin is able to freely engage and disengage the notch, to a transitory position wherein the lever arm distal end is raised manually against bias, to a second position wherein the locking tab resiliently engages the base second end, the latch first end is blocking the throat, and the clevis pin is thereby locked into engagement with the throat; and wherein the body portion, lever arm, and locking tab are molded in one piece from a plastic resin, the plastic resin having sufficient resilience to bias the locking tab downward, the plastic resin having sufficient flexibility to allow the lever arm to move upward to disengage the locking tab, the plastic resin having sufficient strength and stiffness to support the pin against loads imposed upon it by the bimini.

19. The bimini top hook of claim 18, wherein the pin further comprises a bolt and a nut.

20. The bimini top hook of claim 18, wherein the latch further comprises:

a pair of resilient, opposed stop fingers extending outward transversely from either side of the latch second end, and extending from the latch second end part way toward the latch first end, so as to allow the latch second end to pass through the slot in a one direction, and prevent the latch second end from passing through the slot in an opposite direction.

* * * * *